US006047840A

United States Patent [19]

Moore et al.

[11] Patent Number: 6,047,840

[45] Date of Patent: Apr. 11, 2000

[54] BACK-OFF RESISTANT CLOSURE

[75] Inventors: David N. Moore, Plainfield; Richard J. Petro, Mokena, both of Ill.

[73] Assignee: Phoenix Closures, Inc., Naperville, Ill.

[21] Appl. No.: 09/033,307

[22] Filed: Mar. 2, 1998

[51] Int. Cl.[7] ..... B65D 41/04

[52] U.S. Cl. ..... 215/330

[58] Field of Search ..... 215/330, 331

[56] References Cited

U.S. PATENT DOCUMENTS

| | | | |
|---|---|---|---|
| 4,345,691 | 8/1982 | Burke | 215/216 |
| 4,461,394 | 7/1984 | Sendel et al. . | |
| 4,913,299 | 4/1990 | Petro | 215/330 |
| 4,930,647 | 6/1990 | Dutt et al. . | |
| 4,991,733 | 2/1991 | Marino | 215/330 |
| 5,271,512 | 12/1993 | Ekkert | 215/252 |
| 5,285,912 | 2/1994 | Molinaro . | |
| 5,307,946 | 5/1994 | Molinaro . | |
| 5,360,127 | 11/1994 | Barriac et al. | 215/263 |
| 5,593,055 | 1/1997 | Repp et al. . | |
| 5,685,445 | 11/1997 | Dobbs | 215/330 |

*Primary Examiner*—Stephen K. Cronin
*Attorney, Agent, or Firm*—Welsh & Katz, Ltd.

[57] ABSTRACT

A molded, back-off resistant closure for use with an associated container having a neck portion and at least one outwardly projecting ratchet formation includes a generally circular top wall portion and a skirt portion depending from the top wall portion. The skirt includes an inner wall and an outer wall and defines a lower wall portion. The skirt terminates in an edge and includes a thread formation formed in the inner wall for matingly engaging the neck portion of the container. The closure includes a plurality of lugs recessed from the edge and extending radially inwardly from the lower wall and longitudinally along the lower wall portion a distance so as to not touch the edge. The lugs extend outwardly and downwardly such that at least one of the lugs can engage the at least one outwardly projecting ratchet formation on the container neck portion when the container and closure are engaged with one another.

21 Claims, 1 Drawing Sheet

BACK-OFF RESISTANT CLOSURE

FIELD OF THE INVENTION

The present invention pertains to a back-off resistant closure for use with a container, and more specifically to a closure having a plurality of recessed lugs for matingly engaging corresponding ratchet formations on the container to prevent back-off of the closure from the container.

BACKGROUND OF THE INVENTION

Containers that include a threaded closure member, such as bottles, jars or the like, typically include a smooth, integral thread formed on the neck portion of the container. When a closure having a corresponding thread is tightened on the container, there is a tendency for the closure to become loose. This loosening of the closure, commonly referred to as "backing-off", is due in part to vibration incurred during shipping and handling and to the self-lubricating properties of typically used plastic materials. In addition, these materials tend to flow or creep under stress, thus permitting the closure to work itself off to relieve the stresses set up in the threads due to tightening of the closure on the container.

Those skilled in the art will recognize that backing-off can be a significant problem to packagers in that containers having closures which are loose or appear to have been opened are less apt to be selected by consumers for fear of tampering and/or contamination.

Various closure designs have been used to solve the backing-off problem. One known container and closure includes spaced depending appendages extending from the lower edge margins of the threads on the container. The distal edges of the appendages form a second load-bearing surface which engages the threaded portion of an associated closure.

Another known design includes inwardly projecting tooth formations that engage tooth or ratchet formations located on the neck of the closure. Although this prevents inadvertent opening of the closure, this packaging design is typically for a single use application and has proven to be difficult, at best, to adapt to a multiple use application.

Another known design includes a two piece container closure having a lower portion which serves as a locking ring and can be provided with vertically depending auxiliary ridges that tend to bite into or engage an opposing surface in the container. The ridges hold the locking ring against rotation of the closure. One drawback to this design however is that the locking is provided in a separate piece from the actual closure itself.

It has also been observed that with conventional container closures, and particularly molded plastic closures, the lower edge of the cap must be provided with a type of recess to engage the lugged stripper bushing of a conventional "unscrewing" type of injection molding machinery to facilitate removal of the cap from the mold. In applications where the molded cap is used to enclose a container having locking formations on its neck threads, such recesses may interfere with the locking action of the closure on the container.

In addition, it has also been observed that in such lugged or toothed formations for preventing back-off, the closures, more frequently than expected, may not properly set on the container. That is, when "capping" the container, the closure may not engage the container, resulting in a "missed" package. This is problematic in that the capping apparatus must be stopped or shut-down and the closure and uncapped container removed or cleared from the apparatus.

Accordingly, there continues to be a need for a closure that provides significant back-off resistance to prevent loosening of the closure from the container after packaging. Such a closure further reduces the tendency for the closure to skew upon application to the container, and thus provides increased assurance that the closure properly seats on and engages the container during capping operations.

SUMMARY OF THE INVENTION

A molded back-off resistant closure is used with an associated container having a neck portion including at least one outwardly projecting ratchet formation. The closure includes a generally circular top wall portion and a skirt portion depending from the top wall portion. The skirt includes an inner wall and an outer wall and defines a lower wall portion. The lower wall terminates in an edge. The inner wall includes a thread formation formed therein.

The closure includes a plurality of recessed lugs extending radially inwardly from the lower wall portion and extending longitudinally along a portion of the lower wall. The lugs extend longitudinally a distance so as to not touch the edge. The lugs extend outwardly and downwardly such that at least one of the lugs engages the at least one outwardly projecting ratchet formation on the container neck portion.

The lower wall portion includes a length and the lugs extend longitudinally along the lower wall a distance less than the length of the lower wall. Preferably the lugs extend at least about ⅓ of the length of the lower wall portion, and most preferably extend between about ⅓ and about ⅔ of the length of the lower wall portion. In a most preferred embodiment, the inner wall tapers outwardly at about the lower wall portion thus defining a larger effective diameter than that across the lugs.

In a current embodiment, the lugs have a truncated triangular shape and each lug is circumferentially equally spaced from its adjacent lugs. In the current embodiment, each lug and each of its adjacent lugs define gaps therebetween.

The present back-off resistant closure provides significant back-off resistance to prevent loosening of the closure from the container after packaging. The closure further reduces the tendency for the closure to "miss" upon application to the container, thus providing increased assurance that the closure properly seats on and engages the container during capping operations.

Other features and advantages of the present invention will be apparent from the following detailed description, the accompanying drawings, and the appended claims.

DETAILED DESCRIPTION OF THE PREFERRED EMBODIMENTS

Figure 1:
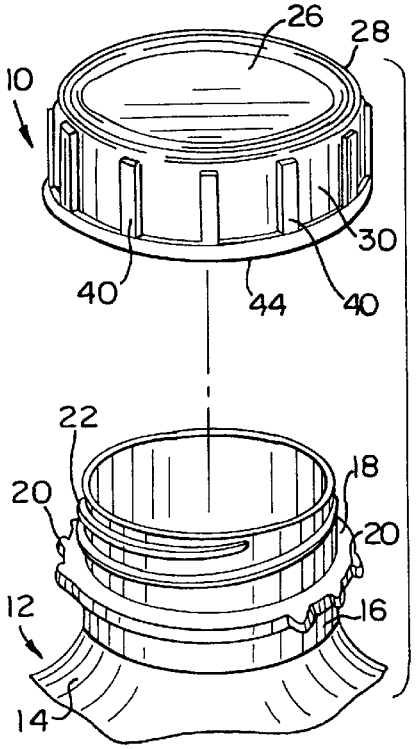
FIG. 1 is a front perspective, elevational view of the closure of the present invention shown exploded away from the neck of an associated container.

Referring now to FIG. 1, there is shown a closure embodying the principles of the present invention designated generally 10 the closure being shown mounted upon a container generally designated 12. The container 12 has a shoulder portion 14 including a vertically projecting tubular neck 16 having a ring formation 18 integral therewith. The ring 18 has a plurality of radially outwardly projecting teeth or ratchet formations 20. The ratchet formations 20 illustrated in FIG. 1 are shown in groups of three, however, the number and spacing of the formations may vary with the particular application. The neck 16 can also be provided with a helical thread 22 that is integrally formed therewith. Preferably, the container 12 is formed of a polymeric material such as polyethylene, polypropylene and the like.

The closure 10 is generally configured as a cap having a circular top wall portion 26 having an outer peripheral edge 28. A depending annular skirt portion 30 depends from the edge 28. The skirt 30 includes an outer wall 32 and an inner wall 34 and defines a lower wall portion 36. The inner wall 34 has formed therein a thread formation 38 that matingly engages the threads 22 of the container 12. The outer wall 32 can include a plurality of vertical ribs 40 to allow the closure 10 to be "capped" or accurately positioned on a container 12 by automatic capping equipment, as will be recognized by those skilled in the art. The vertical ribs 40 can also facilitate gripping or manipulating the closure 10 by a user.

Figure 4:
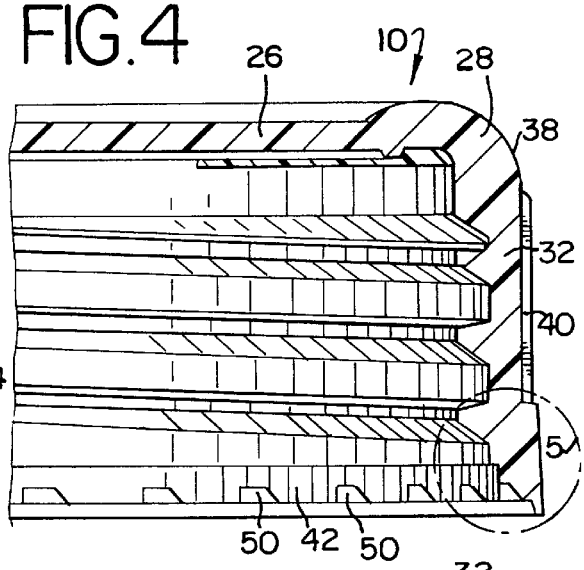
FIG. 4 is a vertical sectional view taken along line 4—4 of FIG. 3.
Figure 5:
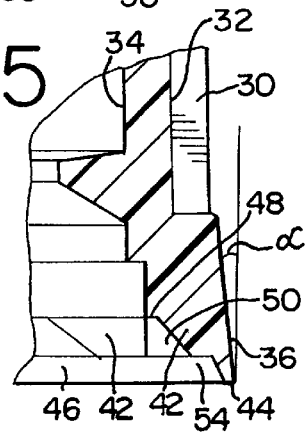
FIG. 5 is a fragmentary sectional view of the closure of FIG. 4.
Figure 6:
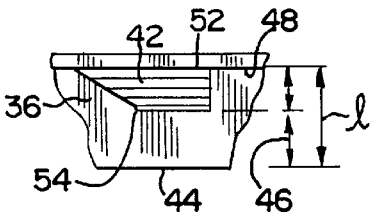
FIG. 6 is a partial sectional view showing a lug adjacent to the recessed lip of the present closure, taken along line 6—6 of FIG. 3.
Figure 7:
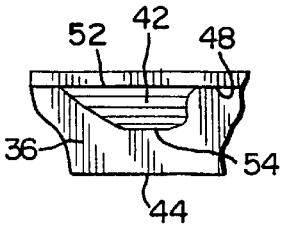
FIG. 7 is a partial sectional view similar to FIG. 6 showing an alternate embodiment of the lug having rounded corners.

Referring now to FIGS. 4–6, the skirt lower wall 36 includes a plurality of inwardly and downwardly extending lugs 42. The illustrated lugs 42 have a generally truncated triangular shape. That is, the lugs 42 have defined, e.g., angled, corners as illustrated in FIG. 6. Alternately, as shown in FIG. 7, the lugs 42 can have rounded or arcuate corners. The lugs 42 extend partially along the lower wall 36 and terminate prior to an edge 44 thereof to define a space or gap 46 that extends longitudinally from the lugs 42 to the edge 44. That is, the lugs 42 are recessed from the edge 44. In a preferred embodiment, the lugs 42 are spaced from one another and extend downwardly from a ledge 48 formed about adjacent to a lowermost point of the bottom thread 38 of the closure 10. Preferably, the lugs 42 are equally circumferentially spaced from one another so as to define a gap or space 50 between each lug 42 and its adjacent lugs 42.

As will be apparent from the drawings, the lugs 42 extend downwardly and inwardly a sufficient distance to engage the container ratchets 20. In a preferred embodiment, the lugs 42 extend downwardly, along the lower wall portion 36, at least about ⅓ of the length 1 of the lower wall portion 36. Most preferably, the lugs 42 extend downwardly between about ⅓ and about ⅔ of the length 1 of the lower wall portion 36.

In a most preferred embodiment, the lower wall portion 36 is outwardly tapered at the inner wall 34 as indicated by angle $\alpha$. That is, the inner wall 34, at the lower wall portion 36, tapers outwardly, which taper extends to the edge 44. In this configuration, the lower wall 36 defines a relatively larger effective diameter than that across the lugs. As will be recognized by those skilled in the art, the present outwardly tapered lower wall portion 36 establishes a larger "target" for capping operations and thus facilitates positioning the closure 10 on an associated container. This configuration reduces or eliminates the tendency for the closure 10 to "miss" as it is applied to the container 12. The outwardly tapered lower wall portion 36 effectively increases the inside diameter of the closure 10 for applying the closure 10 to the container 12.

An exemplary 63 millimeter closure 10 includes 24 equally circumferentially spaced lugs 42. The lower wall portion 36, from about the base of the lugs as indicated at 52 in FIG. 6 to the edge 44, is about 0.10 inches (100 mils) and each lug 42 extends longitudinally along the lower wall portion 36 about 60 mils. Thus, the lug recess or gap 50 that is provided, that extends between the end of each lug, as indicated at 54, and the edge 44, is about 40 mils.

Figure 2:
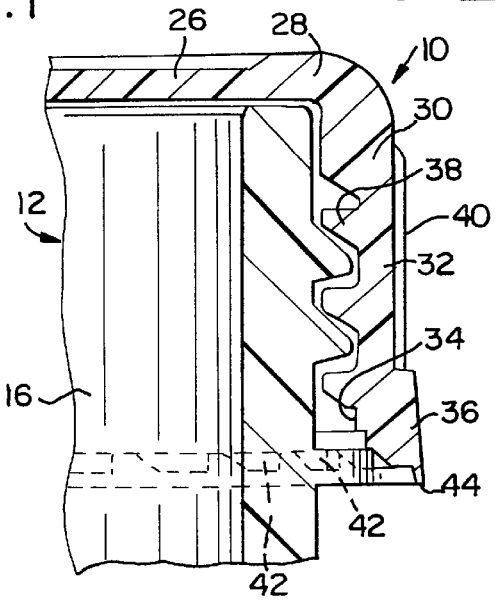
FIG. 2 is a partial vertical sectional view of the closure of FIG. 1 shown in a closed and locked position upon the container of FIG. 1.
Figure 3:
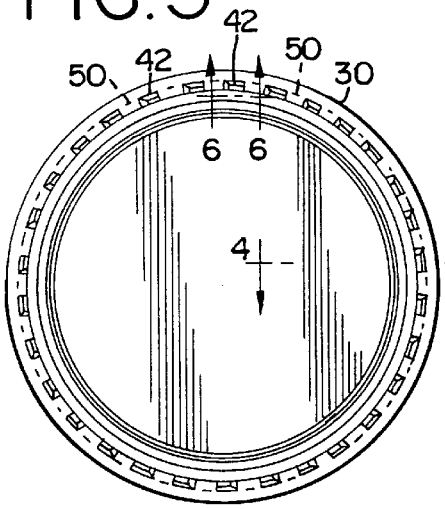
FIG. 3 is a bottom elevational view of the closure of FIG. 1.

The closure 10 is preferably molded of a relatively lightweight plastic material that is flexible and squeezably resiliently deformable. Thus, when the closure 10 is closed upon the container 12, as shown in FIGS. 1–2 the user can squeeze the closure 10 or urge the skirt 30 sides inwardly, so that the lugs 42 can ride over the ratchet formations 20 of the container 12 to release the closure 10 therefrom. Despite its deformability, the closure 10 has sufficient elastic "memory" in that once the user ceases squeezing the skirt 30 walls inwardly, the closure 10 returns to its original configuration.

In use, referring to FIG. 1, the closure 10 is threaded on to the neck 16 of the container 12 with the threads 38 of the closure 10 engaging the threads 22 of the container neck 16. As the closure 10 is brought into close proximity to the container 12 the effective increased diameter of the closure lower wall portion 36 facilitates aligning the closure 10 on the container 12 and facilitates aligning the lugs 42 with the container ratchets 20 once the edge 44 of the skirt 30 is placed in closely adjacent relationship with the container ratchets 20. The closure 10 can be tightened about the container 12, with the ratchets 20 resting within the gaps or spaces 50 between the lugs 42. This tightening action causes an audible and tactile vibration or "click" between the ratchet formations 20 and the gaps 50, which indicates to the user that the closure 10 is locked on the container 12.

When the closure 10 is snugly secured to the container neck 16, the container ratchets 20 matingly engage the gaps or spaces 50 between the lugs 42. In this manner, the closure 10 is prevented against back-off motion which may cause the closure 10 to slightly open. As noted above, the back-off motion can be as a result of vibration or other handling subsequent to the capping process.

Although the closure 10 may be somewhat difficult to remove from the container 12 by some consumers, it does not provide excessive resistance to opening. To remove the closure 10 from the container 12, it is not necessary to apply axial pressure to the closure 10 in a "push-and-twist" motion due to its resiliently deformable construction. Rather, inward urging of the skirt 30 walls while twisting the closure 10 suffices to unlock or release the lugs 42 from the container ratchets 20.

Although unlikely, it is possible that when the closure 10 is closed on to the container 12, the lugs 42 will engage the ratchet formations 20 on the container 12. That is, the lugs 42 and ratchets 20 may lie radially aligned with one another such that the lugs 42 are disposed on the ratchets 20. Although this position is not desirable, it can occur particularly when the closure 10 is tightened upon the container 12 by machine. In the event that this occurs, the closure 10 may back-off slightly relative to the container 12 as a result of vibration during shipping, handling or otherwise, to the point where the ratchet formations 20 rest within the spaces or gaps 50 between the lugs 42. This partial backing-off movement will be sufficiently small that an acceptable seal will still be maintained between the container 12 and the closure 10 and no contamination or spoilage of the product will result. The degree of tightness of the closure 10 on the container 12 can be controlled and regulated by the amount of torque applied by the capping machine.

Those skilled in the art will recognize that at times the closure 10 may engage the container 12 in a closed position where the lugs 42 and the ratchet formations 20 engage one another but are neither lying directly on one another or interposed between each other. That is, the lugs 42 partially overlay the ratchets 20. This also may result in a slight backing-off of the closure 10 relative to the container 12, as described above, until and such that the ratchet formations 20 engage the closure 10 in the spaces or gaps 50 between the lugs 42. Again, this slight backing-off will not result in contamination or spoilage of product located within the container 12 because a sufficient seal between the closure 10 and the container 12 will still be maintained.

An additional advantage of the present closure 10 is that after the initial opening of the container 12, the closure 10 can be repeatedly secured upon the container 12 in a manner to prevent "back-off" and to preserve the container contents. That is, the present closure 10 is not a "one-time" type of closure 10, but is reusable time and again.

Those skilled in the art will also recognize that at times such closures 10 may be fitted with tamper-indicating or tamper-evident bands. Although not specifically shown in the accompanying figures, it is within the scope of the present invention that the closure 10 can include a depending band or other type of tamper-indicating arrangement. Such tamper-indicating arrangements, their design and use will be recognized by those skilled in the art, and are within the scope of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A molded, back-off resistant closure for use with an associated container having a neck portion including at least one outwardly projecting ratchet formation, the closure comprising:

a generally circular top wall portion;

a skirt portion depending from the top wall portion, the skirt including an inner wall and an outer wall and defining a lower wall portion, the skirt terminating in an edge and including a thread formation formed in the inner wall; and a plurality of triangular lugs recessed from the edge and extending radially inwardly from the lower wall portion and longitudinally along the lower wall portion a distance so as to not touch the edge, wherein the lugs extend outwardly and downwardly such that at least one of the lugs can engage the at least one outwardly projecting ratchet formation on the container neck portion when the closure is screwed down onto the container, wherein the lugs taper so as to thin in a direction toward the edge of the skirt.

2. The back-off resistant closure in accordance with claim 1 wherein the lower wall portion has a length and wherein the lugs extend along the lower wall a distance less than the length of the lower wall.

3. The back-off resistant closure in accordance with claim 2 wherein the lugs extend at least about ⅓ of the length of the lower wall portion.

4. The back-off resistant closure in accordance with claim 3 wherein the lugs extend between about ⅓ and about ⅔ of the length of the lower wall portion.

5. The back-off resistant closure in accordance with claim 1 wherein the lugs have a truncated triangular shape.

6. The back-off resistant closure in accordance with claim 1 wherein each lug is circumferentially equally spaced from its adjacent lugs.

7. The back-off resistant closure in accordance with claim 1 wherein the inner wall, at about the lower wall portion, tapers outwardly.

8. A container and closure assembly comprising:

a container defining an interior storage volume, the container including a neck portion having a thread formed therein and having at least one outwardly projecting ratchet formation therein;

a closure having a generally circular top wall portion and a skirt portion depending from the top wall portion, the skirt including inner and outer walls defining a lower wall portion, the skirt terminating in an edge and including a thread formation formed in the inner wall; and a plurality of triangular lugs recessed from the edge and extending radially inwardly from the lower wall portion and longitudinally along the lower wall portion a distance so as to not touch the edge, wherein the lugs extend outwardly and downwardly such that at least one of the lugs can engage the at least one outwardly projecting ratchet formation on the container neck portion when the closure is screwed down onto the container, wherein the lugs taper so as to thin in a direction toward the edge of the skirt.

9. The container and closure package in accordance with claim 8 wherein the closure lower wall portion has a length and wherein the lugs extend along the lower wall a distance less than the length of the lower wall.

10. The container and closure package in accordance with claim 9 wherein the lugs extend at least about ⅓ of the length of the lower wall portion.

11. The container and closure package in accordance with claim 10 wherein the lugs extend between about ⅓ and about ⅔ of the length of the lower wall portion.

12. The container and closure package in accordance with claim 8 wherein the lugs have a truncated triangular shape.

13. The container and closure package in accordance with claim 8 wherein each lug is circumferentially equally spaced from its adjacent lugs.

14. The container and closure package in accordance with claim 8 wherein in inner wall, at about the lower wall portion, tapers outwardly.

15. In a back-off resistant closure that is used with an associated container, the container having a neck portion including at least one outwardly projecting ratchet formation, the closure including a generally circular top wall portion, a skirt portion depending from the top wall portion, the skirt including an inner wall and an outer wall and defining a lower wall portion, the skirt terminating in an edge and including a thread formation formed in the inner wall, the improvement comprising:

a plurality of triangular lugs recessed from the edge and extending radially inwardly from the lower wall portion and longitudinally along the lower wall portion a distance so as to not touch the edge, wherein the lugs extend outwardly and downwardly such that at least one of the lugs can engage the at least one outwardly projecting ratchet formation on the container neck portion when the closure is screwed down onto the container, and wherein the lugs taper so as to thin a direction toward the edge of the skirt.

16. The back-off resistant closure in accordance with claim 15 wherein the lower wall portion has a length and wherein the lugs extend along the lower wall a distance less than the length of the lower wall.

17. The back-off resistant closure in accordance with claim 16 wherein the lugs extend at least about ⅓ of the length of the lower wall portion.

18. The back-off resistant closure in accordance with claim 17 wherein the lugs extend between about ⅓ and about ⅔ of the length of the lower wall portion.

19. The back-off resistant closure in accordance with claim 16 wherein the lugs have a truncated triangular shape.

20. The back-off resistant closure in accordance with claim 16 wherein each lug is circumferentially equally spaced from its adjacent lugs.

21. The back-off resistant closure in accordance with claim 16 wherein the inner wall, at about the lower wall portion, tapers outwardly.

* * * * *